United States Patent [19]

Reid, Jr. et al.

[11] 4,024,839

[45] May 24, 1977

[54] GAS-FIRED SMOOTH TOP RANGE

[75] Inventors: Edward A. Reid, Jr., Westerville; George W. Myler, Upper Arlington; James E. Payne, Columbus, all of Ohio

[73] Assignee: Columbia Gas System Service Corporation, Wilmington, Del.

[22] Filed: Mar. 10, 1975

[21] Appl. No.: 557,032

[52] U.S. Cl. ..... 126/39 J; 431/158

[51] Int. Cl.[2] ..... F24C 3/04

[58] Field of Search ..... 126/39 R, 39 J, 214 C, 126/300; 431/10, 158, 328, 351, 353

[56] References Cited

UNITED STATES PATENTS

| | | | |
|---|---|---|---|
| 2,960,980 | 11/1960 | Williams et al. | 126/39 J |
| 3,241,542 | 3/1966 | Lutter | 126/39 J |
| 3,527,199 | 9/1970 | Perry et al. | 126/39 J |
| 3,606,612 | 9/1971 | Reid, Jr. | 126/39 J X |
| 3,698,378 | 10/1972 | Rosenberg | 126/39 R |
| 3,843,313 | 10/1974 | Helgeson | 126/39 J X |

*Primary Examiner*—Edward G. Favors

*Attorney, Agent, or Firm*—Harold L. Stults

[57] ABSTRACT

A gas cooking range of the smooth top type has four burners positioned under a single plate of heat-resistant glass/ceramic material; and a single igniter and safety control assembly is centrally positioned between the burners. The supply of gas to each of the burners flows through an ignition chamber where it is ignited, and it then flows through a combustion tube to a combustion chamber, where combustion is completed. Some air is mixed with the gas at the fuel supply control valve, and additional air is supplied through the ignition chamber. The burning gas mixture then flows through the combustion tube to the combustion chamber at the entrance of which an additional quantity of air is added to provide the remainder of air necessary for complete combustion. Air is drawn into the system, and the products of combustion are exhausted by a blower positioned at the lower rear of the range so that a negative pressure condition is maintained along the entire path of flow of the fuel gas from the control valve and through the combustion chamber.

21 Claims, 13 Drawing Figures

Fig. 1
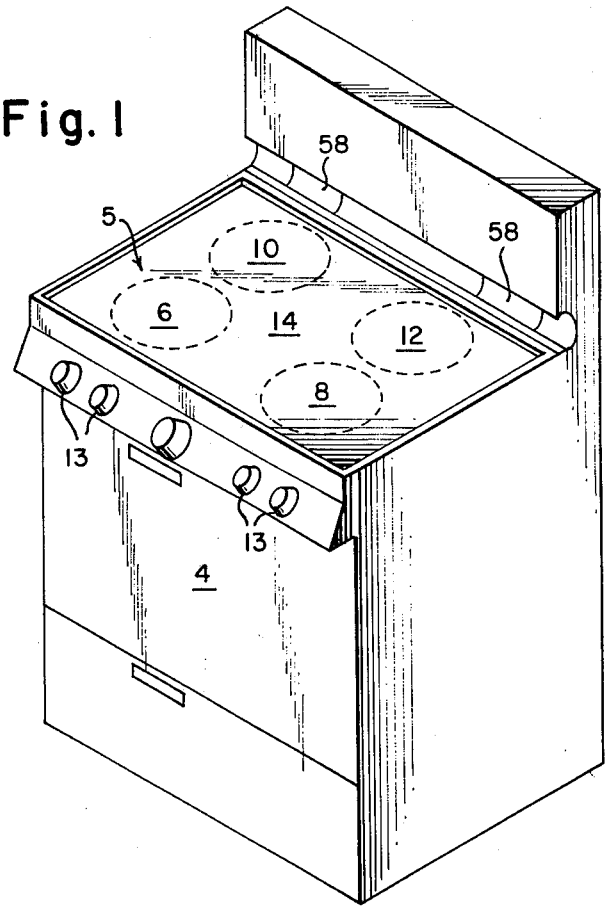
Fig. 6
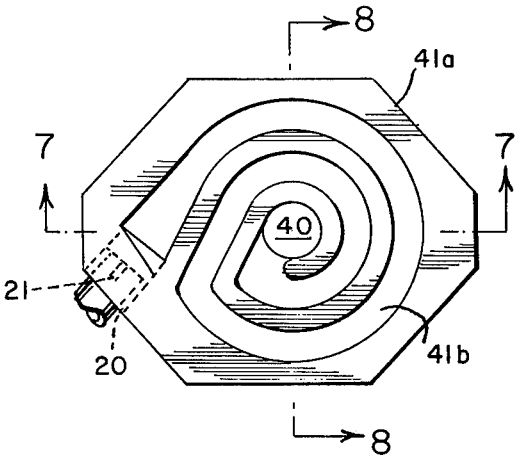
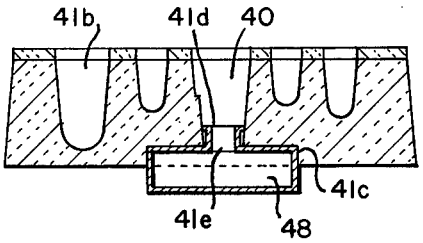
Fig. 7
Fig. 2
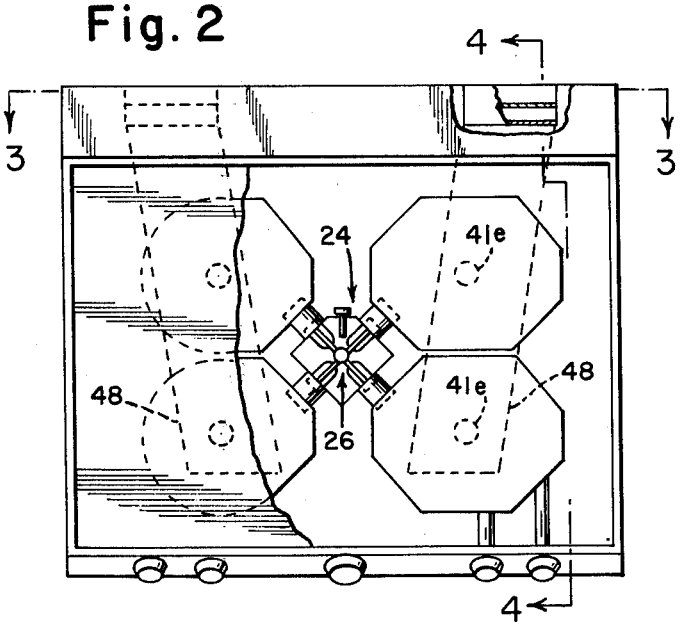
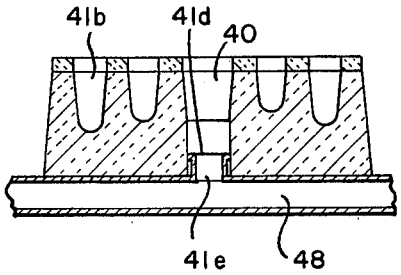
Fig. 8

Fig. 3
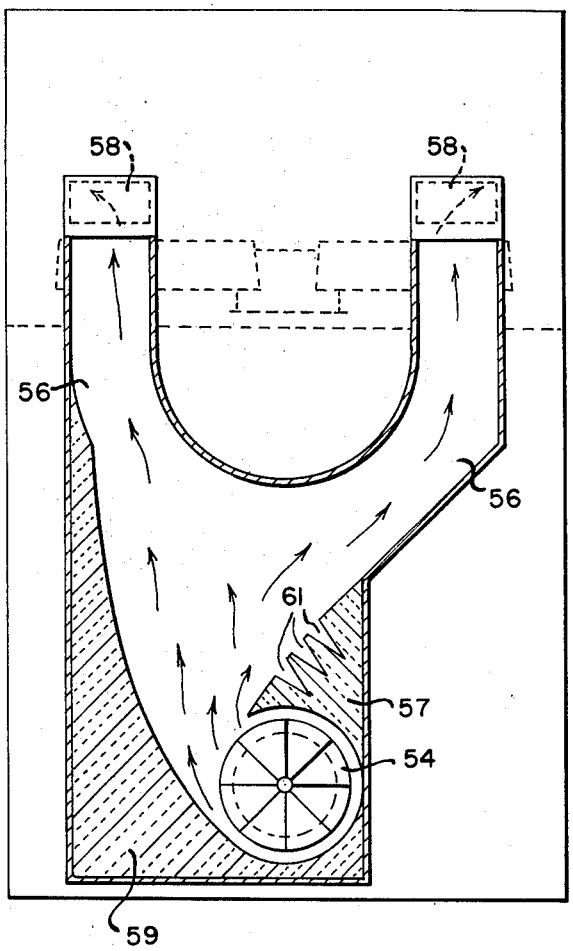
Fig. 4
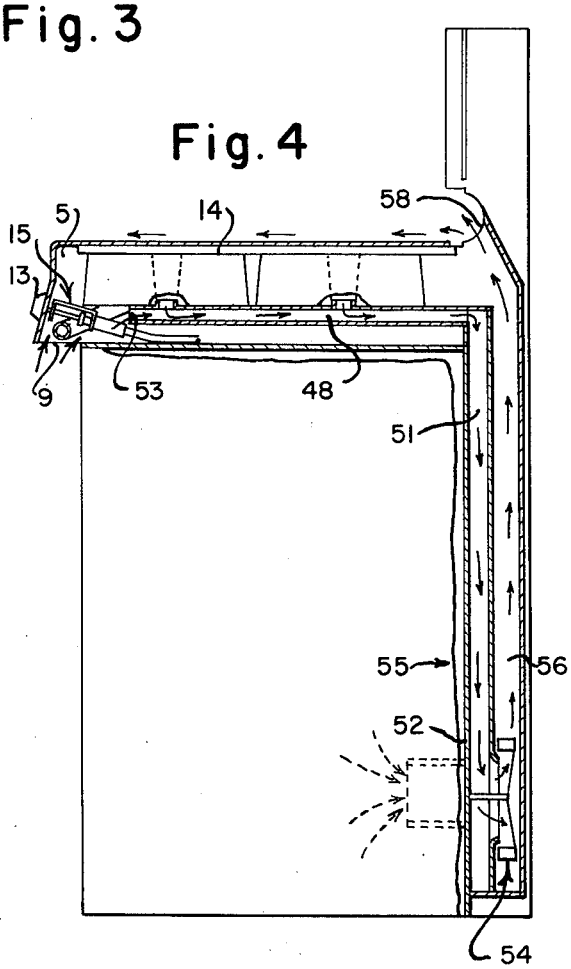
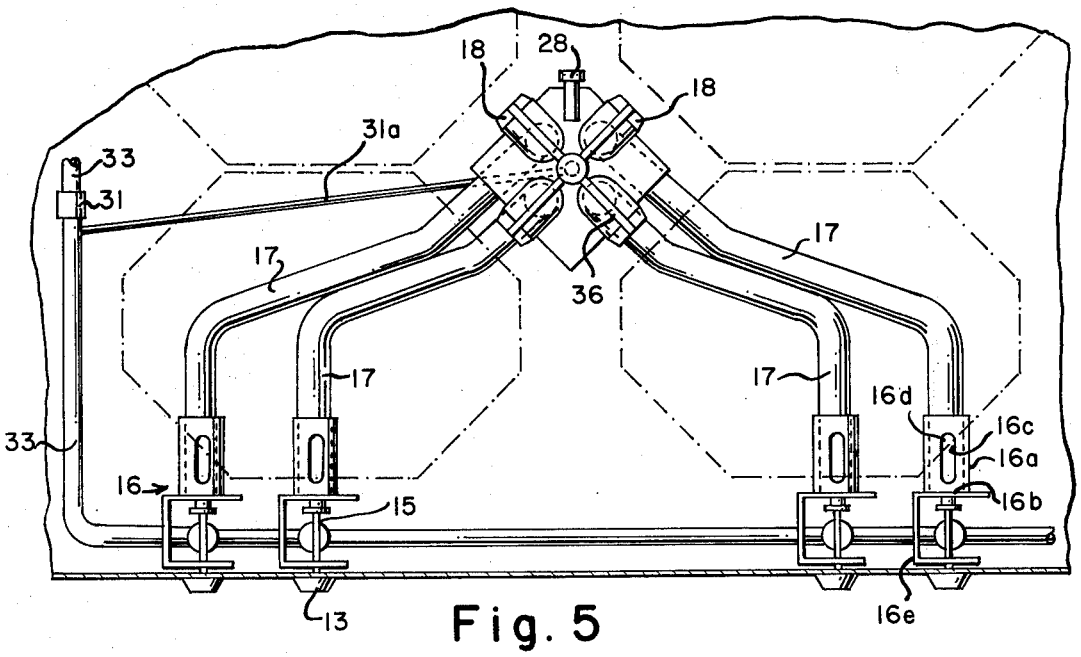
Fig. 5

GAS-FIRED SMOOTH TOP RANGE

This invention relates to cooking ranges and fuel gas burner systems. More particularly, it relates to kitchen gas ranges of the smooth top type, and to systems for supplying fuel gas and air to gas burners.

An object of this invention is to provide improved operation and control for gas cooking ranges. Another object is to provide improved fuel gas and air supply systems for gas burners. A further object is to provide for the above with structures which are free of the limitations which have been present in the prior art. A still further object is to provide for the above with constructions which are simple and sturdy, efficient, dependable and safe in operation, inexpensive to manufacture, and which require minimum service and repair. These and other objects will be in part obvious and in part pointed out below.

Residential smooth top gas ranges have been the object of considerable developmental work. However, the past efforts have not produced a commercially acceptable construction, primarily because of the high production costs associated with solving the technically complex problems involved in combustion and ignition and automatic safety control systems, and in providing more efficient systems. The burners in ranges of this type must burn in an enclosed combustion chamber beneath a plate of heat-resistant glass, and the design and construction must be such as to insure proper combustion and the desired cooking performance. Also, because the burners are positioned beneath the plate of glass/cermanic, they must be treated as "concealed burners," and must have completely reliable systems for providing ignition and for proving that ignition has taken place, and to insure that the gas supply is turned off automatically if there is any malfunctioning. In accordance with the present invention a throughly practical and operable smooth top gas range is provided which meets the highest standards of safety and performance, and which is acceptable from a standpoint of initial cost.

The illustrative embodiment of the present invention is a smooth top gas range of the "powered type" in that a negative pressure or subatmospheric condition is maintained throughout the entire zone occupied by the burners and the fuel gas and air supply system. A single low-pressure blower provides the air required for combustion of the fuel gas, and for drawing the fuel gas and air into the burner combustion chambers and then exhausting and diluting the products of combustion to a reduced temperature so that they can be safely discharged to the atmosphere. The blower also provides the desired air circulation for cooling the entire range-top assembly surrounding the zones of combustion during operation and for cooling down the burner combustion chambers and heat-resistant glass after the range has been turned off.

In the Drawings:

FIG. 1 is a perspective view of a smooth top gas range which constitutes one embodiment of the invention;

FIG. 2 is a top plan view of the range of FIG. 1;

Figure 9:
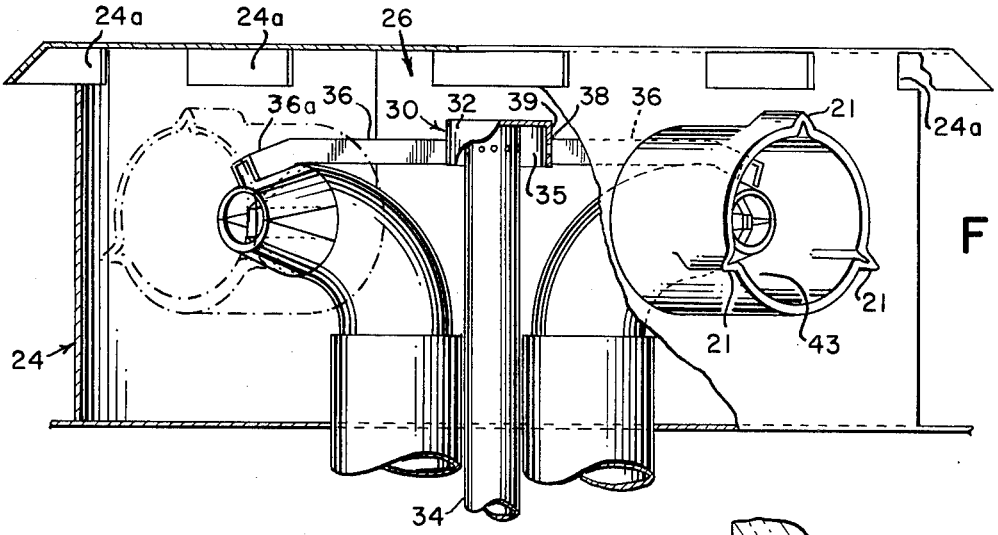
Figure 10:
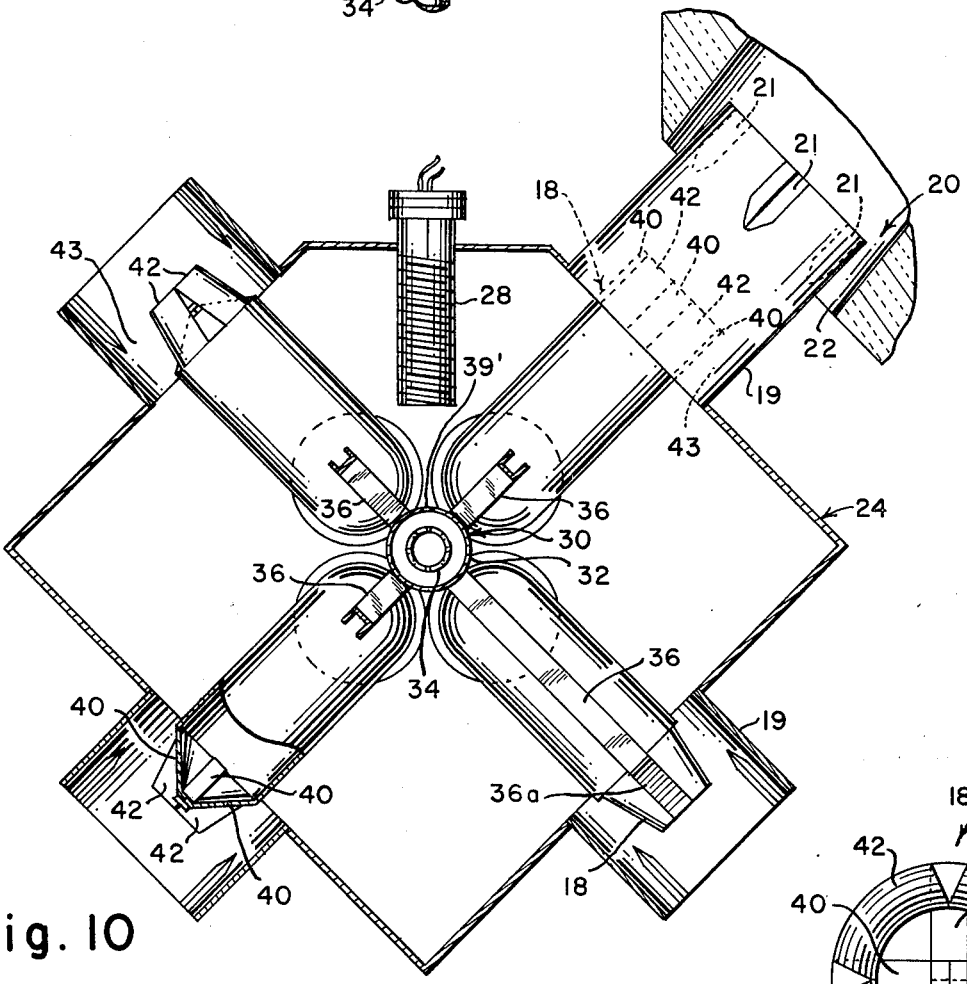
Figure 11:
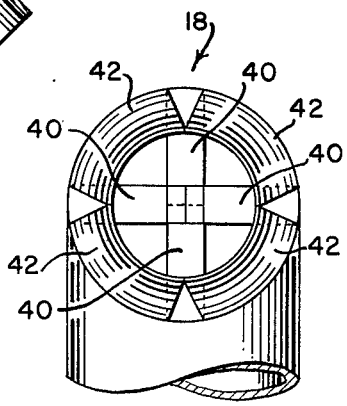
Figure 12:
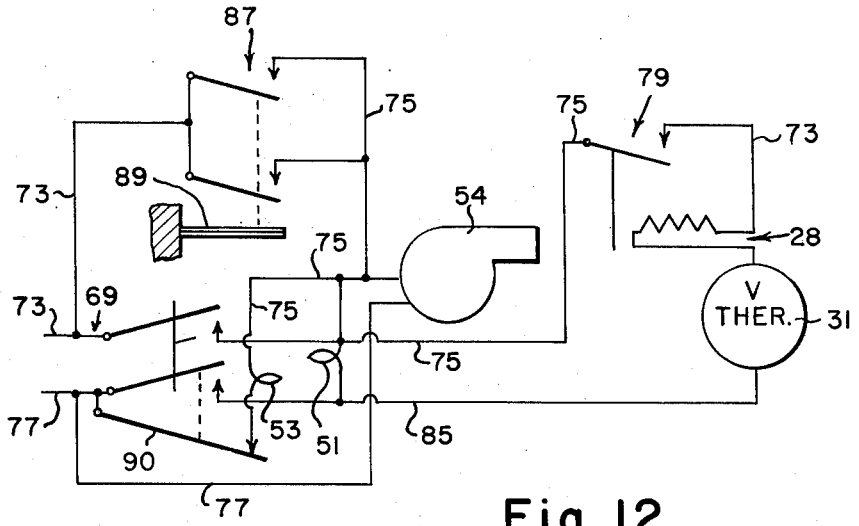
Figure 13:
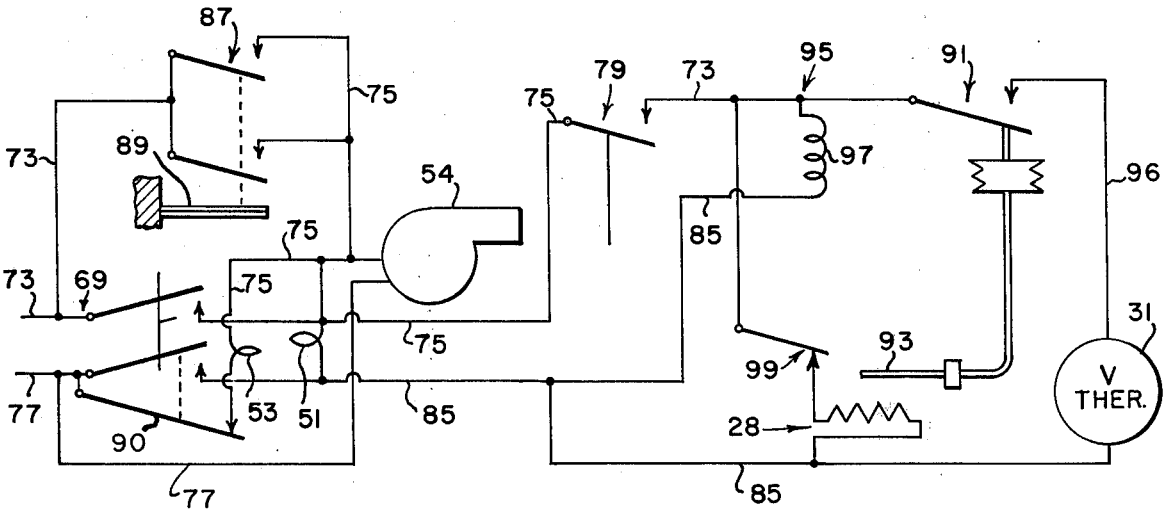

FIGS. 3 and 4 are vertical sections on the lines 3–3, 4–4 respectively on FIGS. 2 and 3;

FIG. 5 is a somewhat schematic view of the fuel gas, and air supply system for the burners in the range of FIG. 1;

FIG. 6 is an enlarged top plan view (with parts broken away) of one of the burner combustion chambers of the range of FIG. 1;

FIGS. 7 and 8 are sectional views respectively on the lines 7–7 and 8–8 of FIG. 6;

FIG. 9 is an enlarged perspective view (with parts broken away) of the ignition system shown at the center of FIG. 2;

FIG. 10 is a top plan view of the ignition system of FIG. 9;

FIG. 11 is a greatly enlarged perspective view of the burner tips of FIG. 9; and FIGS. 12 and 13 are schematic representations of the control systems for the illustrative embodiment.

Referring to FIG. 1 of the drawings, a smooth top gas range has an oven 4, and above the oven there is a double inclusion burner enclosure 5 within which there are four cooking burners which heat areas 6, 8, 10 and 12. The burners have identical fuel gas and air supply and ignition systems. Individually operable fuel supply valves control the flow of gas to the respective burners and are controlled by knobs 13 for valves 15 (FIG. 4). A plate of heat-resistant glass/ceramic 14 covers the entire top of the range and provides the top wall for each of the burner combustion chambers and also for the space between and around the combustion chambers. The burner system is of the indirect infrared type, and plate 14 transmits infrared radiation. When one of the burners is ignited, a load, such as a pot or pan, resting above it on plate 14 is heated by both conduction and radiation through the glass/ceramic plate.

Referring to FIG. 5, the fuel gas and air supply for each of the burners includes: a gas valve 15 which supplies a controlled stream of gas for its burner; a shutter air valve 16; a mixing tube 17 having a burner tip 18 through which the fuel gas and air mixture is discharged, and on which the flame for that burner stabilizes; and a combustion tube 19 (FIG. 10) which receives the ignited stream of fuel gas and air from its burner tip and discharges the stream into the combustion chamber of the respective burners. In the present discussion of the mode of operation we have omitted reference to certain of the safety control features which will be discussed later.

A negative pressure condition exists throughout the flow path for the fuel gas and the air mixed with it, and that acts to draw the air into the fuel gas stream. This negative pressure condition is established by a blower 54 at the rear of the range which as described more fully hereinafter, acts to draw air into the enclosure 5 through openings 9 on the lower side of the range's front panel.

Fuel for the burners is provided through a supply line or manifold 33 upon operation of a thermally actuated valve 31. The jet of fuel produced from valve 15 is projected into its associated mixing tube 17 and simultaneously a stream of air is drawn through the shutter valve 16 into the mixing tube 17 around the jet of fuel gas to form a gas-air mixture. Air shutter valve 16 is gradually opened to supply an increasing amount of air to the mixing tube. The quantity of air supplied to the mixing tube is not sufficient to support combustion of the gas mixture so that there is no danger of flash-back into the mixing tube. As the mixture is discharged from the burner tip 18, additional air enters the end of the combustion tube in the annular space 43 formed around the burner tip by the surrounding end of the combustion tube 19. The air-gas mixture is ignited at this location by a pilot arrangement described below. While there is then a substantially increased amount of air in the stream and the moving gas stream is a flame, there is stil insufficient air to provide complete combustion of the fuel gas. Accordingly, the discharge end of the combustion tube 19 positioned in the inlet port 20 of the combustion chamber formed in the burner block, as described hereinafter, to define an annular space 22 around the discharge end of the combustion tube through which the additional amount of air enters which is necessary for complete combustion of the fuel gas.

Shutter valve 16 (see FIG. 5) is formed by a sleeve 16*a* having an annular end wall 16*b* through which the gas outlet from valve 15 projects into mixing tube 17. Sleeve 16*a* fits snuggly around the mixing tube, and both the sleeve and the tube have oval openings 16*c*, 16*d* respectively which form the operative valve in that they supply the maximum desired amount of air to the mixing tube when they are in alignment (as seen in FIG. 5) and the amount of air is reduced as the sleeve is rotated from that position. Sleeve 16*a* is attached to the stem of valve 15 by a bracket assembly 16*e*. When the gas valve 15 is fully opened, the air inlet openings 16*c*, 16*d* in the sleeve and tube are in alignment to admit the maximum amount of air; when the valve 15 is moved toward its closed position, the sleeve opening 16*c* is moved completely out of alignment with the tube opening 16*d*, thus closing the shutter valve. However, some air leaks into the mixing tube even when the shutter valve is closed during the initial turning movement of valve 15 from its fully closed position.

Centrally positioned between the burners (see FIGS. 2, 9 and 10) beneath plate 14 is an ignition chamber 24 for an ignition system 26. The system includes a known-type silicon-carbide electric resistance igniter 28, and a pilot and ignition tube assembly 30.

The ignition tube assembly is formed by four horizontal flame tubes 36 integral with a central hub 32. The latter is securely mounted upon the top end of a pilot tube 34 which is the gas line through which gas is supplied to provide a pilot flame for each of the burners. Gas for the pilot tube 34 is supplied from manifold 33 downstream of the valve 31 through the conduit 31*a*.

The hub 32 has a slightly larger diameter than the pilot tube 34, in order to provide an annular space 35 around the upper end of the tube. Flame tubes 36 are U-shaped in cross-section, and open along their bottom surface. The tubes have their inner ends 38 positioned and secured in alignment with openings in the outer wall 39 of hub 32 to allow each tube to carry a flame from hub 32 outwardly to its burner tip.

There are eight ports in the upper end of the pilot tube. Four of these ports are aligned axially respectively with the inner ends 38 of the four flame tubes 36, and project a stream of gas along these tubes toward the individual burner tips. One of the ports is aligned axially with an opening 39' in the vertical rim 39 of the hub 32 and projects a stream of gas beyond the hub to the electric resistance igniter 28 which lights the pilot flames. The three additional ports are located around the circumference of the pilot tube, and are directed against the vertical rim 39 of the pilot hub. The gas from these ports impacts against the rim of the hub and spreads within the annular space 35 in the hub. In this manner the jet of gas from opening 39' is ignited and, in turn, ignites the gas from the other openings in the pilot tube, thereby producing a flame throughout annular space 35 to assure that all of the ports on the pilot are lighted from the single electric resistance igniter 28. It is noted that hub 32 and pilot tube 34 are preferably located with respect to each other by cooperating keying elements (not shown) to insure proper alignment of the various ports with the igniter and the flame tubes.

Each of the flame tubes has a downwardly slanting end portion 36*a* which extends along and terminates at the top of the burner tip 18 for its burner. Hence, when the pilot burner is operating, there is a flame at the end of each of the burner tubes which is directly over its burner tip and ignites a fuel gas and air mixture which is discharged from that tip if its valve has been operated.

Each of the burner tips 18 may be formed integral with the end of its mixing tube 17 by slitting the tube to form strips, and then bending the strips radially inwardly. For illustrative purposes only, the original form of the end of the tube is shown in broken lines at the upper right hand burner tip 18 in FIG. 10, wherein four of the eight slits are shown in broken lines. Those slits form narrow tabs or strips 40 and four wide tabs or strips 42. Each of the narrow strips 40 is then bowed inwardly to a somewhat arcuate form to a position where their ends meet to form an open dome-like construction having a square central opening 40'. (See FIG. 11). The wide strips 42 are then bowed inwardly to form an open end. The fuel gas and air mixture is discharged through the burner tip with a great deal of turbulence and stabilized uniform flow. The burner tip is located within the combustion tube, and the gas stream from the burner tip is projected axially within the combustion tube 19. The gas stream is ignited with the additional air which is drawn into the annular space 43 between the tip 18 and tube 19 because of the surrounding negative pressure condition.. In this connection it is noted the ignition chamber 24 has openings 24*a* formed therein through which air can enter, under the influence of blower 54 as described hereinafter, so as to enter the annular space 43.

The combustion chamber for each of the burners is formed from an integral block 41*a* of an insulating fibrous refractory ceramic material with glass/ceramic plate 14 forming the top wall. The combustion chamber is a spiral cavity or channel 41*b*, which winds from an entrance opening 20 to a central exhaust opening 40. The width and depth of the channel are enlarged at the entrance end to permit the entry of the additional air required for combustion of the gas-air mixture through the annular space 22 (see FIG. 10) between the combustion tube 19 and the inlet end of cavity 41*b* and to promote proper mixing of that air with the burning fuel gas mixture from combustion tube 19. The annular space 22 is maintained uniformally about tube 19 by means of spacing projections 21, formed on the tube which serve to hold the periphery of the tube away from contact with channel 41*b*. From the entrance section, the depth of the combustion chamber passage decreases progressively toward the centrally located exahust opening 40. The decreasing cross-sectional area of the combustion chamber passageway compensates for the decreasing volume of the combustion products as heat is transferred from them and their temperature decreases, thus maintaining a relatively constant velocity of the combustion products to optimize heat transfer. The long, narrow passage created by this combustion chamber design increases the residence time of the combustion products in the combustion chamber, assures that the entire surface of the glass which is to be heated to exposed to the products of combustion, and thus improves the uniformity of temperature distribution on the heated surface.

The surfaces of the combustion passage may be roughened to introduce turbulence into the flowing gas stream and increase the surface area heated by the combustion products to increase total amount of infrared radiation generated in the combustion chamber. The surfaces may also be coated with materials such as silicon carbide to improve the radiant emittance of the combustion chamber surfaces. The quantity of radiation generated by the surfaces of the combustion chamber passage is significant since the glass/ceramic which forms the smooth top surface of the range is infrared transparent, and therefore, infrared energy can be delivered efficiently through this glass/ceramic surface to the cooking vessel to be heated. Also, by increasing the quantity of radiation which is delivered through the glass/ceramic to the cooking vessel, the quantity of heat which must be delivered to the glass/ceramic by conduction is decreased, thus decreasing the working temperature of the glass/ceramic. This combination of radiation and convection heat transfer also makes it possible to deliver more heat through the glass/ceramic per square inch of the surface area without exceeding the maximum working temperature of the glass-/ceramic than would be possible if all the heat were transferred by conduction.

The insulating refractory fiber construction of the combustion chamber reduces the amount of heat required to bring the heated surfaces of the combustion chamber up to their optimum working temperature and also reduces the heat loss from the combustion chamber into the surrounding area of the range top, thus making it possible for the rest of the range top to remain cool while one or more burners are in operation. Plate 14 fits tightly against the top flat surface of the ceramic blocks; however a soft crushable interface or gasket 39*a* or the like may be positioned therebetween on the top surface of the block to form a gas seal. In any case the negative pressure condition prevents any tendency for the products of combustion to migrate outwardly from the side edges of the burners.

The products of combustion are exhausted from the burners toward the back of the range through two flue ducts 48 in the burner enclosure 5, one extending rearwardly from beneath burner 6 and thence beneath burner 10, and the other extending rearwardlly from beneath burner 8 and thence beneath burner 12. Each of these ducts has a controlled air inlet opening 53 in the upper half of its front edge through which air is drawn into the duct to control the negative pressure in the combustion systems, and also to cool the products of combustion before they reach the blowerinlet at the rear of the range. Referring to FIGS. 3 and 4, at the back of the range there is an enclosure 55 which extends the width and height of the range. At the rear of the burner enclosure, flue ducts 48 are connected respectively to the tops of a pair of vertical flue ducts 51 which are within enclosure 55 and extend downwardly and join a lower duct 52 to form a Y-duct assembly. At the bottom of duct 52, there is a blower 54 which draws the products of combustion from duct 52 and which directs the resulting mixture of gases upwardly through a discharge duct 56. In discharge duct 56 the exhaust gases are expanded by a factor of two to reduce their velocity and the resulting velocity generated noise. Two shaped peices of fiberglass insulation 57 and 59 control the rate of expansion of the exhaust gases in duct 56, and minimize turbulence and the associated pressure loss. The fiberglass also absorbs a substantial portion of the noise generated by the blade of the blower wheel. Several deep narrow V-shaped notches 61 are cut into insulation block 57 to improve the sound absorption characteristics of the system. This arrangement reduces the noise level approxiamtely 50 percent. The overall shape of the fiberglass blocks also balances the flow of the exhaust system. A small amount of additional air is drawn into duct 52 through the blower motor to keep the motor cool, and provide additional dilution of these products of combustion. Duct 56 terminates behind a vertically disposed grill 58 which extends upwardly along the back edge of the smooth top range. Hence, the products of combustion are diluted and cooled by the addition of the ambient air which is drawn into blower 54, through the duct system from opening 53, and the resulting stream of gases is discharged upwardly at the rear of the range top at a temperature of the order of not more than 250° F. Moreover, the expansion of the gases and the remote positioning of the blower reduce the noise perceived by the user.

As shown in FIG. 7, each of the combustion or burner blocks 41*a* has an inverted channel 41*c* into which its duct 48 is positioned so as to support the block and locate it in both horizontal and vertical positions on the duct in the frame of the stove. In addition, the ducts 48 have annular flanges 41*d* formed thereon which surround openings 41*e* in the ducts and extend into the exhaust openings 40 of the respective burner blocks. Hence, the blocks are located and held fixed in predetermined longitudinal positions along their respective ducts.

Referring to FIG. 12, which is a schematic representation of the control system, the ignition and gas supply system and blower 54 are activated by actuating the "UNIT ON" switch 69 located on the backguard of the range. Switch 69 is connected to a pair of power lines 73 and 77 and, has a normally-open switch unit which connects the high side line 73 through a line 75 to the electric motor of the blower, and the other side of that motor is connected directly to the neutral line 77. When the air flow from the blower has reached design operating conditions, the air flow closes a sail switch 79 which is connected to line 75, and the closing of which then supplies power to the circuit which controls igniter 28 and the fuel gas supply. The main gas supply manifold 33 for the range top receives gas from a thermally actuated bimetal valve 31 which is wired in series with igniter 28. The other electrical terminal of valve 31 is connected through a line 85 which in turn is connected to the neutral line 77 when the normally open unit of switch 69 is closed. Igniter 28 and valve 31 are of known construction.

The electrical resistance of the igniter is relatively high when it is cold and drops to a low value when it reaches the temperature at which it will ignite the gas, and valve 31 opens only when the resistance of the igniter drops, thus increasing the voltage across the valve. Therefore, no gas is available in the range top manifold 33 until the "UNIT ON" switch 69 has been set to the "on" position, the air flow from the blower has reached normal level, and the igniter has reached the necessary ignition temperature. When the gas valve opens, the gas flows to the main manifold and to the pilot tube (through line 31*a*, FIG. 5) and it will also flow to the various burners through their respective valves 15. The gas flowing from the pilot tube is ignited by the electric resistance igniter to produce the pilot flame to ignite the individual burners.

As mentioned, after any one of the burners has been ignited, blower 54 is operated as long as the burner is on and continues to operate after the burner is shut off until the burner temperature has been reduced to a predetermined level by cool air flowing through the unit. That is accomplished by thermally actuated switches 87 connected at one side to line 73 and at the other side to line 75. Switches 87 are normally open, and they are closed by the operation of bimetalic thermostat elements 89. A signal light 51 is connected between lines 75 and 86, and indicates that the UNIT-ON switch is actuated. A signal light 53 is connected between line 75 and a normally closed switch unit 90 which is connected to line 77. Light 53 indicates that the blower is still operating, even though switch 69 has been turned to the UNIT-OFF position with its normally open switches open. It is noted that this system is essentially self proving in that the igniter must ignite the pilots for the burners to operate. If the igniter should fail the valve will close and the blower will remove and dilute any gas entering the system in the intervening period. Thus, the system is entirely safe.

The conrtol system of FIG. 13 is identical with that of FIG. 12, except for the arrangements for controlling the energization of igniter 28 and thermal valve 31. In the system of FIG. 13, line 73 is connected to a relay 95 which has a heated bimetal element 97 connected between lines 73 and 85. The relay has its normally-closed switch 99 connected between line 73 to the igniter, the other side of which is connected to line 85. However, relay 95 is a time delay relay so that its switch opens only after there has been sufficient time for the igniter to ignite the gas. Line 73 is also connected to a normally-open thermostatic switch 91 which has a thermal bulb 93 positioned adjacent igniter 28 and also in the zone where it is heated by the pilot flame. Switch 91 is connected at its other side through a line 96 to valve 31, the other side of which is connected to line 85. Hence, when the igniter reaches the gas igniting temperature, bulb 93 is heated, switch 91 is closed, and valve 31 is opened to supply gas to the manifold. The flame is then ignited, after which the time delay relay switch 99 opens to extinguish the igniter. Valve 31 then remains open as long as the pilot light continues to burn, and power is supplied to the valve through lines 75 and 95. However, if the pilot is extinguished, switch 91 is opened, thus closing valve 31.

It should be noted that in systems of FIG. 12 and 13 blower 54 operates continuously whenever switch 69 is closed, and the first step preparatory to using the range is to close the switch and start the blower. With normal funtioning the igniter is turned on and heated up, and then valve 31 is opened so as to supply gas to the manifold and thence through the pilot tube so that the pilot flame is ignited. Any of the burners can then be ignited by turning the respective control knob at the front of the range. With the control system of FIG. 13, an additional safety feature is provided in that the igniter is turned off after a predetermined period of time, and that results in the opening of switch 91 and closes valve 31 so as to shut off the gas flowing to the manifold if the pilot flame has not ignited.

During operation, a very rich mixture is produced by the controlled amount of air which is added to the stream of fuel gas at valve 15. That amount of air is increased as the gas valve opens, and is from 25 to 30 percent of the amount required for complete combustion of the fuel gas, and is not sufficient to support combustion. An additional amount of air is added at the ignition zone, and the remainder of the air necessary for complete combustion is added at the inlet to the combustion chamber. That control of the flow results from the controlled air inlet openings at shutter valve 16, at the ignition zone, and at the inlet 22 to the combustion chamber. Also involved is the level of the negative or sub-atmospheric pressure which is maintained at the discharge zone from the burner, which is constant for all heat levels.

During low heat operation, a relatively small amount of fuel gas is mixed with a corresponding small amount of air at the valve, but the somewhat unchanged greater quantities are added to the stream at the ignition zone and at the combustion zone. That means that during low heat conditions there is high dilution of the products of combustion with the relatively large quantity of air. That gives the desired lower temperature in the combustion chamber. At high heat conditions there is a greater amount of air added at the valve and substantially the same amount is added at the ignition zone and the combustion zone. That causes more combustion between the ignition zone and the combustion chamber so as to heat up the gas stream which enters the combustion chamber. That is, the ignited gases passing into the combustion chamber are at a high temperature during high heat operation so that the additional air which is added at the combustion chamber does not cool the resultant mixture as much as during low heat operation, and never below the minimum acceptable temperature. The large quantity of air which is mixed with the products of combustion passing to the blower is effective at all times to reduce the temperature of the mixture to an acceptable level.

What is claimed is:

1. A fuel gas burner system comprising, the combination of, means for forming a passageway through which fuel gas flows from an inlet end to an outlet end, valve means at said inlet end and associated therewith for directing controlled amounts of fuel gas and air into said passageway to produce a gas mixture, ignition means adjacent said outlet end of said passageway for igniting said gas mixture flowing from said passageway, said means forming said passageway including burner tip means at said outlet end thereof through which said gas mixture is discharged, said burner tip means producing turbulence in said gas mixture and mixing and entraining ambient air with said gas mixture; means for forming a second passageway through which said gas mixture and entrained ambient air flow together to an outlet end at a heating zone in said system, a combustion chamber positioned at said heating zone, said combustion chamber having an inlet end in alignment with the outlet end of said second passageway for receiving said gas mixture and entrained ambient air, and including means associated with said combustion chamber for permitting ambient air to flow into said combustion chamber with the gases passing from the outlet end of said second passageway, said combustion chamber extending from said inlet end thereof to a discharge zone for the products of combustion.

2. Apparatus as defined in claim 1 wherein said combustion chamber comprises a closed continuous spiral with said discharge zone centrally positioned therein.

3. A fuel gas burner system comprising, the combination of, means for forming a passageway through which fuel gas flows from an inlet end to an outlet end, valve means at said inlet end and associated therewith for directing controlled amounts of fuel gas and air into said passageway to produce a gas mixture, ignition means adjacent said outlet end of said passageway for igniting said gas mixture flowing from said passageway, said means forming said passageway including burner tip means at said outlet end thereof through which said gas mixture is discharged, said burner tip means producing turbulence in said gas mixture and mixing and entraining amibent air with said gas mixture, means for forming a second passageway through which said gas mixture and entrained ambient air flow together to an outlet end at a heating zone in said system, a combustion chamber positioned at said heating zone, said combustion chamber having an inlet end in alignment with the outlet end of said second passageway for receiving said gas mixture and entrained ambient air, and comprising a closed continuous spiral with said discharge zone centrally positioned therein and of progressively reduced cross-section in the direction of flow of the gases, whereby cooling of the gases and the resulting reduction in volume does not cause an objectionable reduction in the rate of flow of the gases along said passageway, and means associated with said combustion chamber for permitting ambient air to flow into said combustion chamber with the gases passing from the outlet end of said second passageway, said combustion chamber extending from said inlet end thereof to a discharge zone for the products of combustion.

4. A fuel gas burner system comprising, the combination of, means for forming a passageway through which fuel gas flows from an inlet end to an outlet end, valve means at said inlet end and associated therewith for directing controlled amounts of fuel gas and air into said passageway to produce a gas mixture, ignition means adjacent said outlet end of said passageway for igniting said gas mixture flowing from said passageway, said means forming said passageway including burner tip means at said outlet end thereof through which said gas mixture is discharged, said burner tip means producing turbulence in said gas mixture and mixing and entraining ambient air with said gas mixture, means for forming a second passageway through which said gas mixture and entrained ambient air flow together to an outlet end at a heating zone in said system, a combustion chamber positioned at said heating zone, said combustion chamber having an inlet end in alignment with the outlet end of said second passageway for receiving said gas mixture and entrained ambient air and, said closed combustion chamber comprises an open generally U-shaped channel and a flat heat transfer plate closing the open side thereof, the cross-sectional dimension of said chamber from said plate being progressively reduced along said combustion chamber in the direction of the gas flow, and means associated with said combustion chamber for permitting ambient air to flow into said combustion chamber with the gases passing from the outlet end of said second passageway, said combustion chamber extending from said inlet thereof to a discharge zone for the products of combustion.

5. A range top having a fuel gas burner system comprising a pluraltiy of combustion chambers each of which comprises the combination of, means for forming a passageway through which fuel gas flows from an inlet end to to an outlet end, valve means at said inlet end and associated therewith for directing controlled amounts of fuel gas and air into said passageway to produce a gas mixture, ignition means adjacent said outlet end of said passageway for igniting said gas mixture flowing from said passageway, said means forming said passageway including burner tip means at said outlet end thereof through which said gas mixture is discharged, said burner tip means producing turbulence in said gas mixture and mixing and entraining ambient air with said gas mixture, means for forming a second passageway through which said gas mixture and entrained ambient air flow together to an outlet end at a heating zone in said system, a combustion chamber positioned at said heating zone, said combustion chamber having an inlet end in alignment with the outlet end of said second passageway for receiving said gas mixture and entrained ambient air, and a duct system and blower means for drawing a substantial amount of ambient air to said system for mixing with said products of combustion, said duct system including one horizontal duct on each side of the range top to move the products of combustion from the combustion chambers with additional ambient air to the rear of the range, one vertical inner duct for collecting and mixing the products of combustion from the two horizontal ducts and delivering them to said blower, and a second vertical duct into which said blower discharges the products of combustion upwardly to the discharge opening in said range.

6. Apparatus as defined in claim 5 wherein each of said horizontal ducts has openings in its top surface which are respectively aligned with the discharge openings in their associated combustion chambers and through which the products of combustion enter the ducts for discharge from the range.

7. Apparatus as defined in claim 6 in which said ducts are operatively engaged with said combustion chambers to position the combustion chambers in three dimensions.

8. Apparatus as defined in claim 5 in which said horizontal ducts have controlled air openings at the inlet ends thereof through which additional ambient air is introduced into the duct system.

9. Apparatus as defined in claim 8 wherein said air inlet openings are dimensioned to control the quantity of air which is supplied to the burner for combustion.

10. Apparatus as defined in claim 9 wherein said inlet openings comprise at least one horizontal slot extending the full width of its associated duct, and located near the top of the duct cross-section.

11. Apparatus as defined in claim 5 wherein said one vertical duct is Y-shaped and collects the diluted combustion products from both horizontal ducts.

12. Apparatus as defined in claim 11 wherein said air blower provides a negative pressure in the entire range top and combustion system, and discharges the diluted products of combustion from the range under positive pressure.

13. Apparatus as defined in claim 11 wherein said second vertical duct is in the shape of a modified "Y," and directs the diluted combustion products upward, separates them into two distinct flow streams and causes them to be discharged through an opening in the range.

14. Apparatus as defined in claim 13 including sound absorbent material positioned in said second vertical duct in the region surrounding the blower housing to absorb sound energy produced by the blower, and thereby reduce the noise level from the blower 15. Apparatus as defined in claim 14 wherein said blower has a scroll-shaped housing and said sound absorbent material is shaped to extend the curvature of the scroll shaped housing to control the rate of expansion of the diluted combustion products into said second vertical duct.

16. Apparatus as defined in claim 15 wherein a plurality of deep, narrow V-shaped notches are formed in said sound absorbent material to further increase the sound absorption of the system.

17. In a fuel gas burner system, the combination of, a burner comprising a ceramic plate having an elongated spiral open cavity therein and a flat plate closing one side thereof and forming a combustion chamber, said burner having a gas inlet port at the outer end of the spiral by which a fuel gas and air mixture is supplied to said combustion chamber and an exhaust port at the inner end of the spiral through which the products are exhausted, means to withdraw the products of combustion from said exhaust port of said combustion chamber and thereby produce a sub-atmospheric pressure condition within said combustion chamber and at said inlet port, means forming an ignition passageway extending to said inlet port and adapted to deliver an ignited stream fo fuel gas and air to adjacent said inlet port of said combustion chamber with the proportion of air to fuel gas being deficient in air in that it is less than the amount necessary for complete combustion of the fuel gas at high input conditions, means at the outlet from said ignition passageway through which a stream of additional air enters said ignited stream as it approaches said combustion chamber at said inlet port, said additional air being sufficient to satisfy said deficiency for complete combustion of the fuel gas.

18. The construction as described in claim 17 which includes means to supply a mixture of fuel gas and air to said ignition passageway including a mixing passageway and means which is capable of supplying controlled streams of fuel gas and air to said mixing passageway with the amount of air present in said mixing passageway being below that necessary to support combustion, means to supply additional air to said ignition passageway, and means to ignite the fuel gas and air mixture in the presence of additional air passing to said ignition passageway.

19. A fuel gas burner system comprising, the combination of, means for forming a passageway through which fuel gas flows from an inlet end to an outlet end, means at said inlet end and associated therewith for directing controlled amounts of fuel gas and air into said passageway to produce a gas mixture, burner tip means at said outlet end thereof through which said gas mixture is discharged and is subjected to turbulence with the gas mixture entraining ambient air, ignition means adjacent said burner tip for igniting said gas mixture, means forming an annular air inlet passageway surrounding said burner tip through which air flows to be entrained with the gas mixture, said gas mixture and entrained ambient air being ignited and flowing together toward a heating zone, and a closed continuous spiral combustion chamber positioned at said heating zone having an inlet at the outer end of the spiral through which the ignited gas and air mixture enters the combustion chamber, and said combustion chamber having a discharge port at the central portion of the sprial, whereby the ignited gas and air mixture enters said combustion chamber after being ignited and then flows along a continuous spiral path through said combustion chamber.

20. In the fuel gas burner system in a cooking range, the combination of, a burner comprising a ceramic member having an elongated spiral open cavity therein and a flat plate closing one side thereof and forming a closed combustion chamber with a gas inlet port at the outer end of the spiral by which a fuel gas and air mixture is supplied to said combustion chamber and an exhaust port at the central portion of the spiral through which the products of combustion are exhausted therefrom, means to withdraw the products of combustion from said exhaust port and thereby produce a sub-atmospheric pressure condition within said combustion chamber and at said inlet port, means forming a supply passageway having an inlet end and an outlet end, means to deliver a stream of fuel gas and air to said inlet end of said supply passageway with the proportion of said air to said fuel gas being deficient in air in that it is less than the amount necessary for complete combustion of the fuel gas, means forming an ignition passageway having an inlet for ambient air surrounding said outlet end of said passageway through which a stream of air enters and mixes with said stream of fuel gas and air to satisfy said deficiency for complete combustion of the fuel gas, and ignition means to ignite the stream of fuel gas and air prior to entry into said combustion chamber, the flow path for the fuel gas and air after ignition being sufficient to permit the stream to reach an elevated temperature thereby to avoid the entry of unheated ambient air into the combustion chamber.

21. In a fuel gas burner system in a cooking range, the combination of, a burner comprising a ceramic member having an elongated spiral open cavity therein and a flat plate closing one side thereof and forming a closed combustion chamber with a gas inlet port at the outer end of the spiral by which a fuel gas and air mixture is supplied to said combustion chamber and an exhaust port at the central portion of the spiral through which the products of combustion are exhausted therefrom, means to withdraw the products of combustion from said exhaust port and thereby produce a sub-atmospheric pressure condition within said combustion chamber and at said inlet port, means forming a supply passageway having an inlet end and an outlet end, means to deliver a stream of fuel gas and air to said inlet end of said supply passageway with the proportion of said air to said fuel gas being deficient in air in that it is less than the amount necessary for combustion of the fuel gas, means forming an ignition passageway having an inlet for ambient air surrounding said outlet end of said passageway through which a stream of air enters and mixes with said stream of fuel gas and air to satisfy said deficiency for combustion of the fuel gas, ignition means to ignite the stream of fuel gas and air prior to entry into said combustion chamber, and means to supply additional ambient air to the fuel gas mixture around the perimeter of said ignition passageway as the fuel gas and air mixture enters the combustion chamber to provide the additional air required for complete combustion at high fuel gas inputs.

* * * * *